US007558506B2

(12) United States Patent
Okuda

(10) Patent No.: US 7,558,506 B2
(45) Date of Patent: Jul. 7, 2009

(54) STATIC REMOVING DEVICE FOR AN IMAGE FORMING APPARATUS

(75) Inventor: Katsumi Okuda, Shiga (JP)

(73) Assignee: Kyocera Corporation, Kyoto (JP)

( * ) Notice: Subject to any disclaimer, the term of this patent is extended or adjusted under 35 U.S.C. 154(b) by 96 days.

(21) Appl. No.: 11/616,306

(22) Filed: Dec. 27, 2006

(65) Prior Publication Data

US 2007/0177896 A1 Aug. 2, 2007

(30) Foreign Application Priority Data

Jan. 27, 2006 (JP) ..... 2006-019723
Oct. 30, 2006 (JP) ..... 2006-293579

(51) Int. Cl.
*G03G 21/00* (2006.01)

(52) U.S. Cl. ..... 399/128

(58) Field of Classification Search ..... 399/128, 399/343

See application file for complete search history.

(56) References Cited

U.S. PATENT DOCUMENTS

| | | | | |
|---|---|---|---|---|
| 5,003,350 | A * | 3/1991 | Yui et al. | 399/43 |
| 5,729,799 | A * | 3/1998 | Numao et al. | 399/128 |
| 5,999,773 | A | 12/1999 | Yasutomi et al. | |
| 6,744,995 | B2 * | 6/2004 | Fukuyama et al. | 399/50 |
| 2005/0002691 | A1 * | 1/2005 | Jung et al. | 399/128 |
| 2007/0036566 | A1 * | 2/2007 | Takeuchi et al. | 399/27 |

FOREIGN PATENT DOCUMENTS

| | | | |
|---|---|---|---|
| JP | 142664 | | 6/1989 |
| JP | 04271379 | | 9/1992 |
| JP | 06011944 | A * | 1/1994 |
| JP | 06324535 | A * | 11/1994 |
| JP | 2519414 | | 5/1996 |
| JP | 120172 | | 5/1997 |
| JP | 269685 | | 10/1997 |
| JP | 10039640 | | 2/1998 |
| JP | 11072992 | | 3/1999 |
| JP | 330981 | | 11/2001 |
| JP | 2006023390 | A * | 1/2006 |
| JP | 2006259577 | A * | 9/2006 |

* cited by examiner

*Primary Examiner*—Quana M Grainger
(74) *Attorney, Agent, or Firm*—Volpe and Koenig, P.C.

(57) ABSTRACT

An image-forming device according to the present invention includes an electrophotographic photoreceptor including a photosensitive layer, a pressing member pressed against the photosensitive layer of the electrophotographic photoreceptor to remove a deposit from the photosensitive layer, and a static eliminating unit for eliminating the static electricity of the deposit to be removed by the pressing member. Another image-forming device according to the present invention includes an electrophotographic photoreceptor including a photosensitive layer and an electroconductive pressing member that comes into contact with a deposit on the photosensitive layer of the electrophotographic photoreceptor to eliminate the static electricity of the deposit.

2 Claims, 8 Drawing Sheets

STATIC REMOVING DEVICE FOR AN IMAGE FORMING APPARATUS

CROSS-REFERENCE TO RELATED APPLICATIONS

The present application claims priority under 35 U.S.C. §119 to Japanese Patent Application No. 2006-19723, filed Jan. 27, 2006, and Japanese Patent Application No. 2006-293579, filed Oct. 30, 2006, entitled "IMAGE-FORMING DEVICE." The contents of these applications are incorporated herein by reference in their entirety.

BACKGROUND OF THE INVENTION

1. Field of the Invention

The present invention relates to an image-forming device.

2. Description of the Related Art

In general, image-forming devices, such as electrophotographic copying machines or printers, perform the following processes during image formation. First, the surface of a latent image formation region of an electrophotographic photoreceptor is electrically charged uniformly by a charging member while the electrophotographic photoreceptor is rotated. Then, the latent image formation region is irradiated with a laser beam according to an image pattern to form a latent image on the electrophotographic photoreceptor. Toner is deposited on the electrophotographic photoreceptor according to the latent image. Then, the toner is transferred to a recording medium. Then, the electrophotographic photoreceptor is wiped with a cleaning blade to remove a deposit including residual toner.

The cleaning blade is a plate having almost the same length as the electrophotographic photoreceptor. An edge of the cleaning blade is pressed against the electrophotographic photoreceptor to remove a deposit including residual toner from the electrophotographic photoreceptor.

When a deposit is removed with the cleaning blade, the friction between residual toner particles or between the cleaning blade and residual toner can generate static electricity. Electrostatically charged toner stays in upstream region of the cleaning blade in the rotation direction of the electrophotographic photoreceptor.

The static electricity built up on the residual toner may be discharged to the electrophotographic photoreceptor substrate. Thus, a photoconductive layer or a surface layer of the electrophotographic photoreceptor may be damaged (discharge breakdown). Accordingly, there is a need for a high-quality image-forming device that can prevent the discharge breakdown.

SUMMARY OF THE INVENTION

An image-forming device according to the present invention includes an electrophotographic photoreceptor including a photosensitive layer, a pressing member, and a static eliminating unit. The pressing member is pressed against the photosensitive layer of the electrophotographic photoreceptor to remove a deposit from the photosensitive layer. The static eliminating unit eliminates the static electricity of the deposit to be removed by the pressing member.

An image-forming device according to the present invention includes an electrophotographic photoreceptor including a photosensitive layer and an electroconductive pressing member. The pressing member is disposed on the electrophotographic photoreceptor so that the pressing member comes into contact with a deposit on the photosensitive layer of the electrophotographic photoreceptor and thereby eliminates the static electricity of the deposit.

DESCRIPTION OF THE PREFERRED EMBODIMENTS

First Embodiment

An image-forming device according to a first embodiment of the present invention is described in detail below with reference to FIGS. 1A, 2, 3A, and 3B.

Figure 1A:
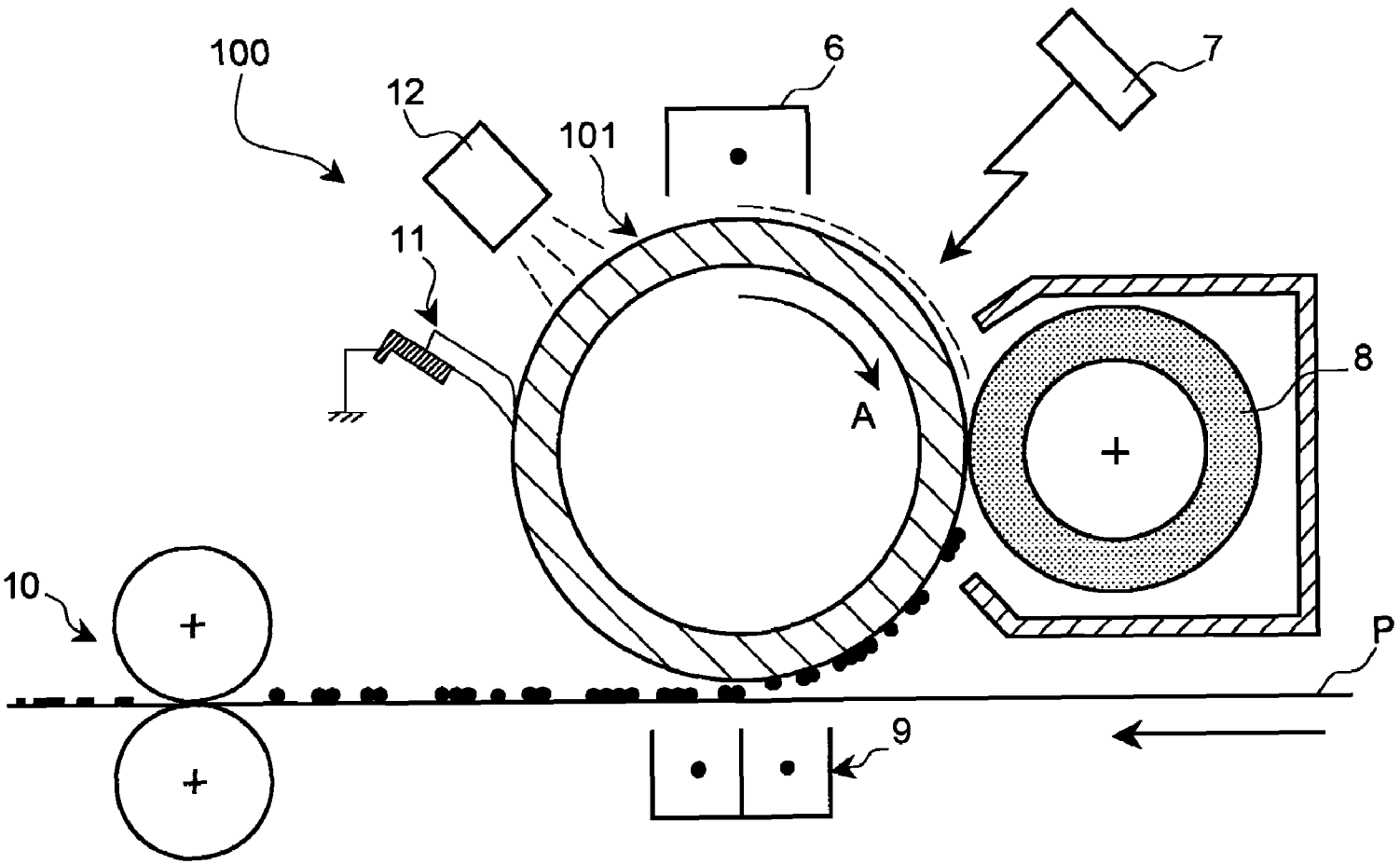
FIG. 1A is a schematic cross-sectional view of an image-forming device according to a first embodiment of the present invention.

As illustrated in FIG. 1A, an image-forming device 100 according to the present embodiment includes an electrophotographic photoreceptor 101 including a photosensitive layer, a charger 6 for electrifying the photosensitive layer, an exposure unit 7 for irradiating the electrophotographic photoreceptor 101 with light after electrification to form an electrostatic latent image on the electrophotographic photoreceptor 101, and a developing unit 8 containing toner for forming a toner image corresponding to the electrostatic latent image on the electrophotographic photoreceptor 101. The exposure unit 7 may be an exposure means such as a light-emitting diode (LED) head or laser.

The image-forming device 100 further includes a transfer unit 9 for transferring the toner image to a recording medium P, a cleaning blade 11, which is a pressing member for removing residual toner from the electrophotographic photoreceptor 101 after transfer, a static eliminator 12 for eliminating a residual electrostatic latent image after transfer, and a fixing unit 10 for fixing the toner image transferred to the recording medium P by heat or pressure. The cleaning blade 11 is electrically conductive and constitutes a static eliminating unit for eliminating the static electricity of a deposit, such as residual toner.

The image-forming device 100 forms an image by performing the following processes.

The following processes are performed while the electrophotographic photoreceptor 101 is rotated via gear flanges 102 disposed on both ends of the electrophotographic photoreceptor 101.

1. The charger 6 electrifies the surface of the electrophotographic photoreceptor 101.

2. A charged region in the electrophotographic photoreceptor 101 is exposed to light from the exposure unit 7 to form an electrostatic latent image on the electrophotographic photoreceptor 101 as a potential contrast image.

3. The electrostatic latent image is developed by the developing unit 8. In this developing process, toner in the developing unit 8 is attached to the surface of the electrophotographic photoreceptor 101 by electrostatic attraction and visualizes the electrostatic latent image.

4. Upon the application of an electric field opposite in polarity to the toner from the back of the recording medium P, such as a sheet of paper, the toner image on the electrophotographic photoreceptor 101 is electrostatically transferred to the recording medium P, forming an image on the recording medium P.

5. Residual toner on the electrophotographic photoreceptor 101 is physically removed from the electrophotographic photoreceptor 101 by the cleaning blade 11. The cleaning blade 11 eliminates the static electricity of the residual toner before or during the removal of the residual toner.

6. The electrophotographic photoreceptor 101 is exposed to strong light from the static eliminator 12 to erase the residual electrostatic latent image.

7. A member for isolating a deposit (not shown) conveys the removed toner from the electrophotographic photoreceptor 101 to a toner collection box (not shown), thus isolating the removed toner from the electrophotographic photoreceptor 101.

The components of the image-forming device 100 are described below.

Figure 2:
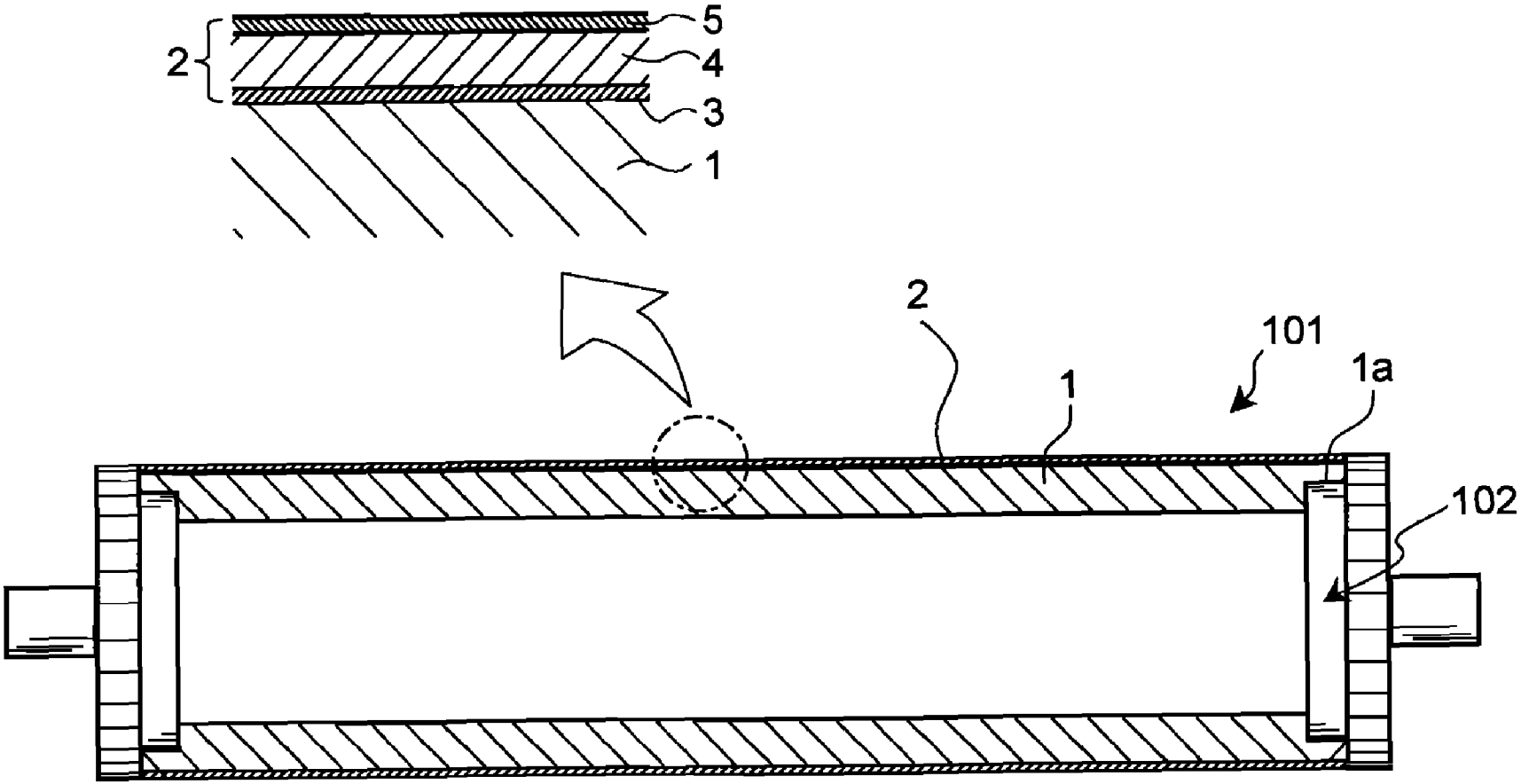
FIG. 2 is a cross-sectional view of an electrophotographic photoreceptor according to the first embodiment to the third embodiment of the present invention.

As illustrated in FIG. 2, the electrophotographic photoreceptor 101 includes a cylindrical electroconductive substrate 1 and a photosensitive layer 2 disposed on the substrate 1. The photosensitive layer 2 includes a charge injection-preventing sublayer 3, a photoconductive sublayer 4, and a surface sublayer 5 disposed on the substrate 1 in this order. The axial length of the substrate 1 may be larger than the length of a recording medium P, such as a sheet of paper.

The electrophotographic photoreceptor 101 retains electric charges on the surface sublayer 5 to hold an electrostatic latent image formed by the charger 6 and the exposure unit 7 on the surface sublayer 5.

The electrophotographic photoreceptor 101 may have inlow portions 1*a* at the axial ends of the substrate 1. The inlow portions 1*a* have a thickness smaller than that of the midsection of the substrate 1. Because of the inlow portions 1*a*, the inner diameter of the substrate 1 is larger at the both ends than at the midsection. The inlow portions 1*a* fit gear flanges 102 for rotating the electrophotographic photoreceptor 101 during the operation of the image-forming device, achieving stable rotation of the electrophotographic photoreceptor 101. Thus, when the gear flanges 102 can consistently transfer rotational power to the electrophotographic photoreceptor 101 without the inlow portions, the inlow portions 1*a* are not necessary.

Examples of a material of the substrate 1 include electroconductive materials including metallic materials, such as Al, stainless steel (SUS), Zn, Cu, Fe, Ti, Ni, Cr, Ta, Sn, Au, or Ag, or alloys thereof. The material of the substrate 1 may be a combination of an insulating material and an electroconductive material. For example, the substrate 1 includes a resinous, glass, or ceramic insulating body and an electroconductive film disposed on the insulating body. The electroconductive film may be formed of the above-described electroconductive materials or transparent electroconductive materials such as indium tin oxide (ITO) or $SnO_2$. The electroconductive film may be formed by vapor deposition. The material of the substrate 1 is not limited to the materials described above. Preferably, the substrate 1 is grounded.

Among the materials described above, an Al—Mn-based alloy, an Al—Mg-based alloy, or an Al—Mg—Si-based alloy is preferred, because they can reduce the cost and the weight. In addition, when the charge injection-preventing sublayer 3 and/or the photoconductive sublayer 4 is formed of an amorphous silicon (hereinafter referred to as a-Si)-based material, the Al—Mn-based alloy, the Al—Mg-based alloy, or the Al—Mg—Si-based alloy can increase the adhesion between the substrate 1 and the charge injection-preventing sublayer 3 and/or between the substrate 1 and the photoconductive sublayer 4, improving the reliability of the electrophotographic photoreceptor 101.

Such an Al alloy is processed into an Al alloy tube by casting, homogenization, hot extrusion, cold drawing, and, if necessary, softening. The Al alloy tube is cut into pieces having a predetermined length. The surface, end faces, and chamfers of an Al piece are processed by cutting to produce the substrate 1.

A photosensitive layer 2 is disposed on the substrate 1. The photosensitive layer 2 includes a charge injection-preventing sublayer 3, a photoconductive sublayer 4, and a surface sublayer 5.

The charge injection-preventing sublayer 3 formed of an inorganic material is disposed on the substrate 1. The charge injection-preventing sublayer 3 blocks electric charges (electrons or positive holes) entering from the substrate 1.

The charge injection-preventing sublayer 3 may appropriately be formed according to the material of the photoconductive sublayer 4. For example, when a main component of the photoconductive sublayer 4 is an a-Si-based material, the charge injection-preventing sublayer 3 formed of an a-Si-based material can increase the adhesion between the photoconductive sublayer 4 and the charge injection-preventing sublayer 3.

When the charge injection-preventing sublayer 3 is formed of an a-Si-based material, the charge injection-preventing sublayer 3 may contain a larger amount of group 13 element or group 15 element than those in the a-Si-based photoconductive sublayer 4. Alternatively, the charge injection-preventing sublayer 3 may contain boron (B), nitrogen (N), and/or oxygen (O) to increase the resistance.

A light-absorbing sublayer for absorbing long-wavelength light (light having a wavelength of at least 0.8 μm) may replace the charge injection-preventing sublayer 3. When the light-absorbing sublayer is placed on the substrate 1, the light-absorbing sublayer absorbs long-wavelength light entered at the time of exposure. Thus, interference fringes, which are generated on a recorded image by long-wavelength light reflecting from the surface of the substrate 1, can be reduced.

The photoconductive sublayer 4 formed of an inorganic material is disposed on the charge injection-preventing sublayer 3. Examples of the inorganic material include a-Si-based materials, an amorphous selenium (a-Se)-based materials, such as a-Se, Se—Te, and $As_2Se_3$, and group II-VI compounds, such as ZnO, CdS, and CdSe. The photoconductive sublayer 4 may be formed of an organic material in place of the inorganic material. For example, the photoconductive sublayer 4 may be a photoconductive sublayer in which particles of the inorganic material described above are dispersed in a resin or may be an organic photoconductor (OPC) sublayer. The photoconductive sublayer 4 formed of an a-Si-based material, such as a-Si or an a-Si-based alloy containing C, N, and/or O is preferred for its high photosensitivity, high-speed responsivity, repetition stability, heat resistance, and high durability. In addition, this photoconductive sublayer 4 has high compatibility with a surface sublayer 5 formed of amorphous silicon carbide (a-SiC) containing hydrogen (hereinafter referred to as a-SiC:H).

Examples of the a-Si-based material for use in the charge injection-preventing sublayer 3 and the photoconductive sublayer 4 include a-Si, a-SiC, amorphous silicon nitride (a-SiN), amorphous silicon oxide (a-SiO), amorphous silicon-germanium (a-SiGe), amorphous silicon cyanide (a-SiCN), amorphous silicon oxynitride (a-SiNO), amorphous silicon oxycarbide (a-SiCO), or amorphous silicon oxycarbonitride (a-SiCNO). The a-Si-based material may be deposited by glow discharge decomposition, sputtering, vapor deposition, electron cyclotron resonance (ECR), photochemical vapor deposition (photo-CVD), catalytic chemical vapor deposition (CVD), or reactive evaporation. Each of the charge injection-preventing sublayer 3 and the photoconductive sublayer 4 may contain 1 to 40 atomic percent of hydrogen (H) and/or halogen (F, Cl, etc.) to be bound to a dangling bond. Furthermore, each of the charge injection-preventing sublayer 3 and the photoconductive sublayer 4 may contain 0.1 to 20000 ppm of group 13 element or group 15 element and/or 0.01 to 100 ppm of C, N, and/or O to achieve desired electrical characteristics, such as dark conductivity and photoconductivity, and a desired photonic band gap.

Among these, the group 13 element and the group 15 element are preferably boron (B) and phosphorus (P), respectively, because boron and phosphorus can easily form a covalent bond, easily change semiconducting properties, and achieve excellent photosensitivity. When the charge injection-preventing sublayer 3 and the photoconductive sublayer 4 contain a group 13 element and a group 15 element together with C, N, and/or O, the group 13 element is preferably in the range of 0.1 to 20000 ppm and the group 15 element is preferably in the range of 0.1 to 10000 ppm.

In the absence of C, N, and O or in the presence of a small amount (0.01 to 100 ppm) of C, N, and/or O, each of the charge injection-preventing sublayer 3 and the photoconductive sublayer 4 preferably contains 0.01 to 200 ppm of group 13 element and 0.01 to 100 ppm of group 15 element. The contents of these elements may vary in the thickness direction, provided that the average contents in the sublayers are within the ranges described above.

The charge injection-preventing sublayer 3 and the photoconductive sublayer 4 may be formed of microcrystal silicon (μc-Si) in place of the a-Si-based material. μc-Si can increase the dark conductivity and/or the photoconductivity of the sublayers and thereby increase the design freedom of the photoconductive sublayer 4. The charge injection-preventing sublayer 3 and the photoconductive sublayer 4 each formed of μc-Si can be formed by the above-mentioned method (glow discharge decomposition, sputtering, vapor deposition, ECR, photo-CVD, catalytic CVD, or reactive evaporation) under different film-forming conditions. For example, in the glow discharge decomposition, the temperature of a substrate, the high-frequency power, and the flow rate of diluent hydrogen gas are higher than those for a-Si. When the charge injection-preventing sublayer 3 and the photoconductive sublayer 4 contain μc-Si, they can also contain the impurity element described above.

The resistance of the photoconductive sublayer 4 decreases on exposure to light (having a wavelength in the range of 580 nm to 780 nm). When the photoconductive sublayer 4 is irradiated with light having a predetermined pattern emitted from the exposure unit 7, resistances in some portions are reduced and a resistance in the rest is substantially constant. In the portions having reduced resistances, electric charges move from the photoconductive sublayer 4 to the substrate 1. In the rest of the photoconductive sublayer 4, electric charges remain in the photoconductive sublayer 4. This movement of electric charges generates portions containing toner and portions free of toner, thus forming an electrostatic latent image.

An inorganic surface sublayer 5 is disposed on the photoconductive sublayer 4 to protect the photoconductive sublayer 4 from the friction against the recording medium P. When the surface sublayer 5 is formed of a-SiC:H, its thickness is in the range of 0.2 to 1.5 μm and is preferably in the range of 0.5 to 1.0 μm. When the a-SiC:H has a composition formula of a-$Si_{1-X}C_X$:H, X is in the range of $0.55 \leqq X < 0.93$ and is preferably in the range of $0.6 \leqq X \leqq 0.7$.

The surface sublayer 5 having a thickness of at least 0.2 μm can prevent image defects and inconsistent color densities caused by friction. Furthermore, the surface sublayer 5 having a thickness of 1.5 μm or less can improve the initial properties, for example, can effectively prevent image defects caused by a residual potential. When X is 0.55 or more, the surface sublayer 5 can have appropriate hardness and durability. When X is less than 0.93, the surface sublayer 5 can have appropriate hardness.

The charger 6 for use in the present embodiment may be a corotron. The corotron includes a base, wire supports disposed on the base, and a wire placed between the wire supports and substantially parallel to axial direction of the electrophotographic photoreceptor 101. The wire is disposed at a predetermined distance from the electrophotographic photoreceptor 101. The distance may be controlled with insulating resin wheels. The insulating resin wheels are in contact with the substrate 1 of the electrophotographic photoreceptor 101 at positions where a latent image will not be formed. A bias voltage is applied to the wire to electrify the surface of the electrophotographic photoreceptor 101.

The charger 6 may also be a charging roller. In the charging roller, the axle may be coated with an electroconductive rubber, which may further be coated with polyvinylidene fluoride (PVDF). The charging roller comes into contact with the electrophotographic photoreceptor 101 and electrifies the surface of the electrophotographic photoreceptor 101.

The exposure unit 7 irradiates the electrophotographic photoreceptor 101 with light having a wavelength of 580 nm to 780 nm to form a latent image on the electrophotographic photoreceptor 101. The image-forming device 100 according to the present embodiment includes an LED head as the exposure unit 7. The LED head includes light-emitting elements having a wavelength of 650 nm. The light-emitting elements are arranged parallel to the electrophotographic photoreceptor 101 at a density of 600 dots per inch.

The developing unit 8 forms a toner image on an electrically charged latent image formed on the electrophotographic photoreceptor 101. The developing unit 8 includes a magnetic roller for magnetically holding toner, an agitator for stirring toner particles, and wheels for controlling the distance from the electrophotographic photoreceptor 101. The wheels may be the same as those used in the charger 6.

The transfer unit 9 applies a bias voltage opposite in polarity to that of the charger 6 to the electrophotographic photoreceptor 101 to transfer a toner image formed on the electrophotographic photoreceptor 101 to a recording medium P, such as a sheet of paper. In general, the bias voltage is a DC bias voltage including superimposed alternating components.

The fixing unit 10 fixes the toner image formed on the recording medium P, such as a sheet of paper. In general, a hot metal roller coated with a fluorocarbon resin is pressed against the recording medium P to fix the toner image.

While the image-forming device 100 performs a common dry development, a liquid developer for use in wet development can also be used.

The image-forming device 100 according to the present embodiment also includes the cleaning blade 11, which is a pressing member for removing a deposit including toner left on the electrophotographic photoreceptor 101 after the transferring process. An edge of the cleaning blade 11 is in contact with the latent image formation region of the electrophotographic photoreceptor 101. The edge is pressed against the photosensitive layer 2 utilizing the elasticity of the cleaning blade 11.

Specifically, the edge (in contact with the surface sublayer 5) of the cleaning blade 11 has a thickness of 1.0 to 1.2 mm and a linear pressure of 14 N/m (typically 5 to 29 N/m). The edge of the cleaning blade 11 may have a Shore hardness of 74 (preferably in the range of 67 to 84), as determined by ISO 868.

Figure 3A:
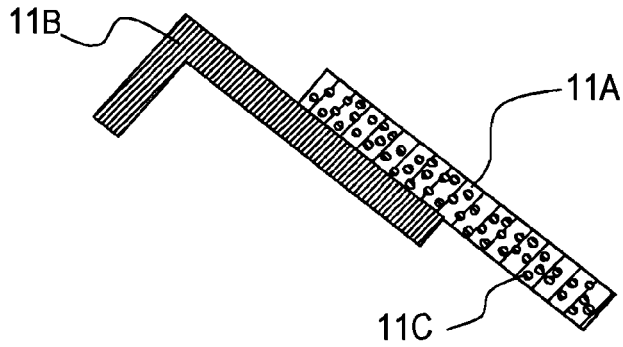
FIG. 3A is a cross-sectional view of a cleaning blade according to the first embodiment of the present invention.

Furthermore, the cleaning blade 11 is electrically conductive and also functions as a static eliminating unit. Specifically, as illustrated in FIG. 3A, the cleaning blade 11 includes a pressing substrate 11A and a metal support 11B. The pressing substrate 11A is composed of a polyurethane resin and a great number of electroconductive particles 11C, such as gold pearl, dispersed therein. The support 11B holds the pressing substrate 11A. The pressing substrate 11A is electrically connected to the support 11B, which is grounded. The static electricity built up on a deposit, such as residual toner, is therefore discharged through the cleaning blade 11. This reduces the discharge breakdown of the photoconductive sublayer 4 and the surface sublayer 5 caused by the static electricity built up on the deposit. The support 11B is grounded when it is mounted on an image-forming device 100. The pressing substrate 11A is pressed against the photosensitive layer 2 of the electrophotographic photoreceptor 101.

Such an electroconductive cleaning blade 11 is manufactured as follows. First, a great number of electroconductive metal particles 11C are mixed with a liquid polyurethane resin precursor. The mixture is extruded into the pressing substrate 11A. The pressing substrate 11A is bonded to the support 11B with an electroconductive adhesive, thus forming the cleaning blade 11. While the electroconductive particles 11C are preferably metal particles, they may be nonmetal particles, provided that the nonmetal particles have an electric conductivity higher than that of the pressing substrate 11A.

Figure 3B:
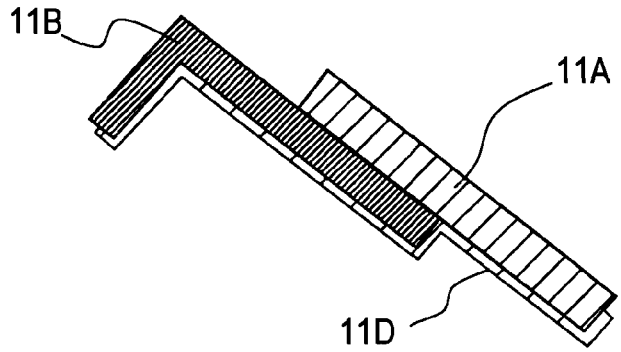
FIG. 3B is a cross-sectional view of a cleaning blade according to the first embodiment of the present invention.

As illustrated in FIG. 3B, the cleaning blade 11 may include a pressing substrate 11A, a metal support 11B for holding the pressing substrate 11A, and an electroconductive thin film 11D, such as a thin metal film, bonded to the pressing substrate 11A and the support 11B. The electroconductive thin film 11D is provided to eliminate the static electricity of a deposit on the photosensitive layer 2. The electroconductive thin film 11D is therefore bonded to an edge of the pressing substrate 11A to be accessible to the photosensitive layer 2. Furthermore, because the electroconductive thin film 11D is bonded to the grounded metal support 11B, the static electricity of a deposit on the photosensitive layer 2 is discharged outside through the electroconductive thin film 11D. This reduces the discharge breakdown of the photoconductive sublayer 4 and the surface sublayer 5 caused by the static electricity of a deposit, such as residual toner.

Figure 4:
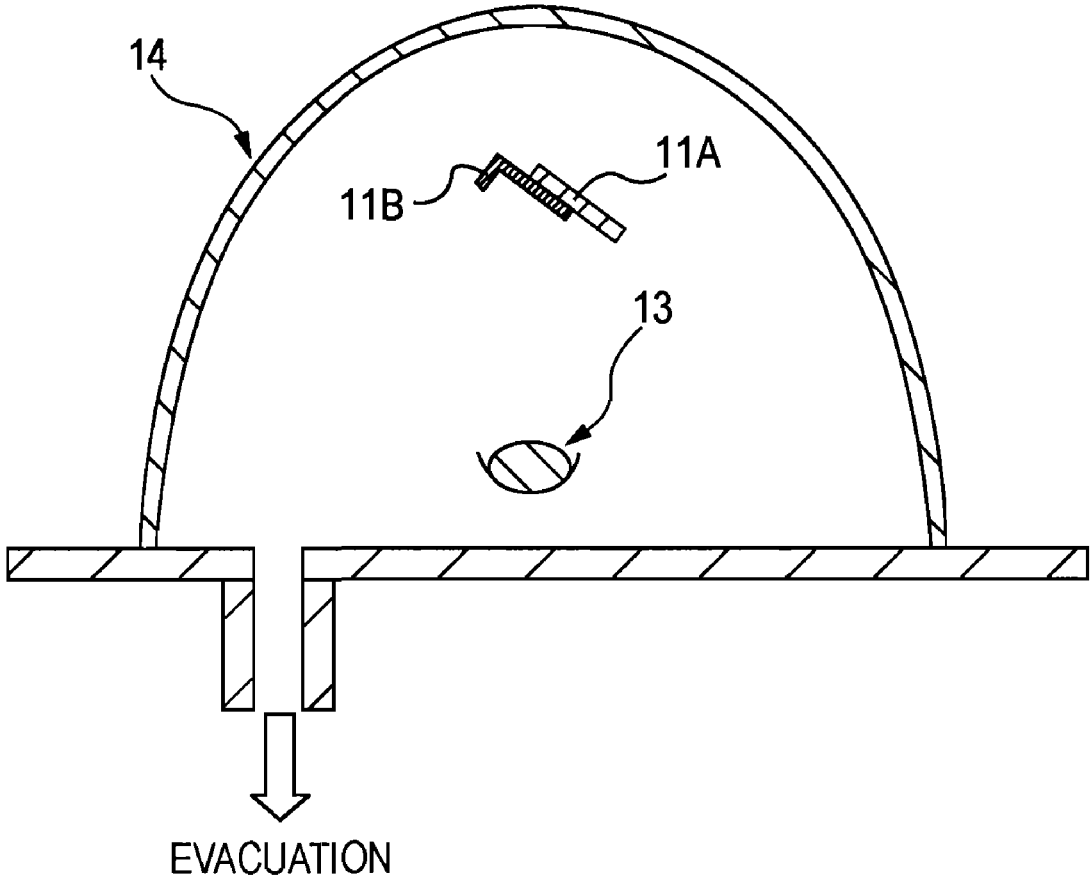
FIG. 4 is a cross-sectional view of an example of a film-forming apparatus for coating a pressing member and a support with an electroconductive thin film.

The cleaning blade 11 illustrated in FIG. 3B may be manufactured as follows. First, a polyurethane resin is molded into the pressing substrate 11A. Then, the pressing substrate 11A is bonded to the metal support 11B with an electroconductive adhesive. Finally, the electroconductive thin film 11D is formed on the pressing substrate 11A and the metal support 11B by vapor deposition. This vapor deposition is preferably performed as illustrated in FIG. 4. Specifically, the support 11B, the pressing substrate 11A, and an evaporation source 13 composed of an electroconductive material are placed in a vacuum chamber 14. Then, the electroconductive material is simultaneously evaporated onto the pressing substrate 11A and the support 11B. Thus, the electroconductive thin film 11D is continuously formed over the pressing substrate 11A and the support 11B. While the electroconductive thin film 11D is preferably formed of a metallic material, it may be a nonmetallic material, provided that the nonmetallic material has an electric conductivity higher than that of the pressing substrate 11A.

The cleaning blade 11 illustrated in FIG. 3B has an area in contact with toner on the electrophotographic photoreceptor 101 larger than the cleaning blade 11 illustrated in FIG. 3A and therefore eliminates the static electricity more efficiently. Hence, the cleaning blade 11 illustrated in FIG. 3B is preferred in terms of elimination of static electricity.

However, in the cleaning blade 11 illustrated in FIG. 3B, the electroconductive thin film 11D tends to be worn away. Hence, when a long-term stable elimination effect of static electricity is desired, the cleaning blade 11 illustrated in FIG. 3A is preferred. The cleaning blade illustrated in FIG. 3A and the cleaning blade illustrated in FIG. 3B may be combined. That is, the electroconductive thin film 11D may be bonded to the pressing substrate 11A containing the electroconductive particles 11C. While the whole pressing substrate 11A may be formed of an electroconductive material having a low hardness (such as Cu, Al, or Au), the pressing substrate 11A entirely formed of the electroconductive material tends to have a high hardness. In this case, the photosensitive layer 2 of the electrophotographic photoreceptor 101 is preferably formed of a-Si.

The operation of the image-forming device 100 according to the present embodiment includes a first step of eliminating the static electricity of a deposit on the photosensitive layer 2 with the cleaning blade 11 illustrated in FIG. 3A or 3B and a second step of removing a neutralized deposit from the photosensitive layer 2 with the cleaning blade 11. These steps can reduce discharge breakdown during the operation of the image-forming device 100. The first step and the second step may be performed at the same time. Alternatively, the first step may be followed by the second step. In both cases, discharge breakdown during the removal of a deposit can be prevented or reduced.

The image-forming device 100 according to the present embodiment may further include a static eliminator 12 for removing a latent image formed on the electrophotographic photoreceptor 101. The static eliminator 12 irradiates the electrophotographic photoreceptor 101 with light having a particular wavelength in the range of 580 nm to 780 nm. In this embodiment, the static eliminator 12 is an LED head including light-emitting elements having a wavelength of 670 nm. The light-emitting elements are arranged along axial direction of the electrophotographic photoreceptor 101.

Second Embodiment

Figure 1B:
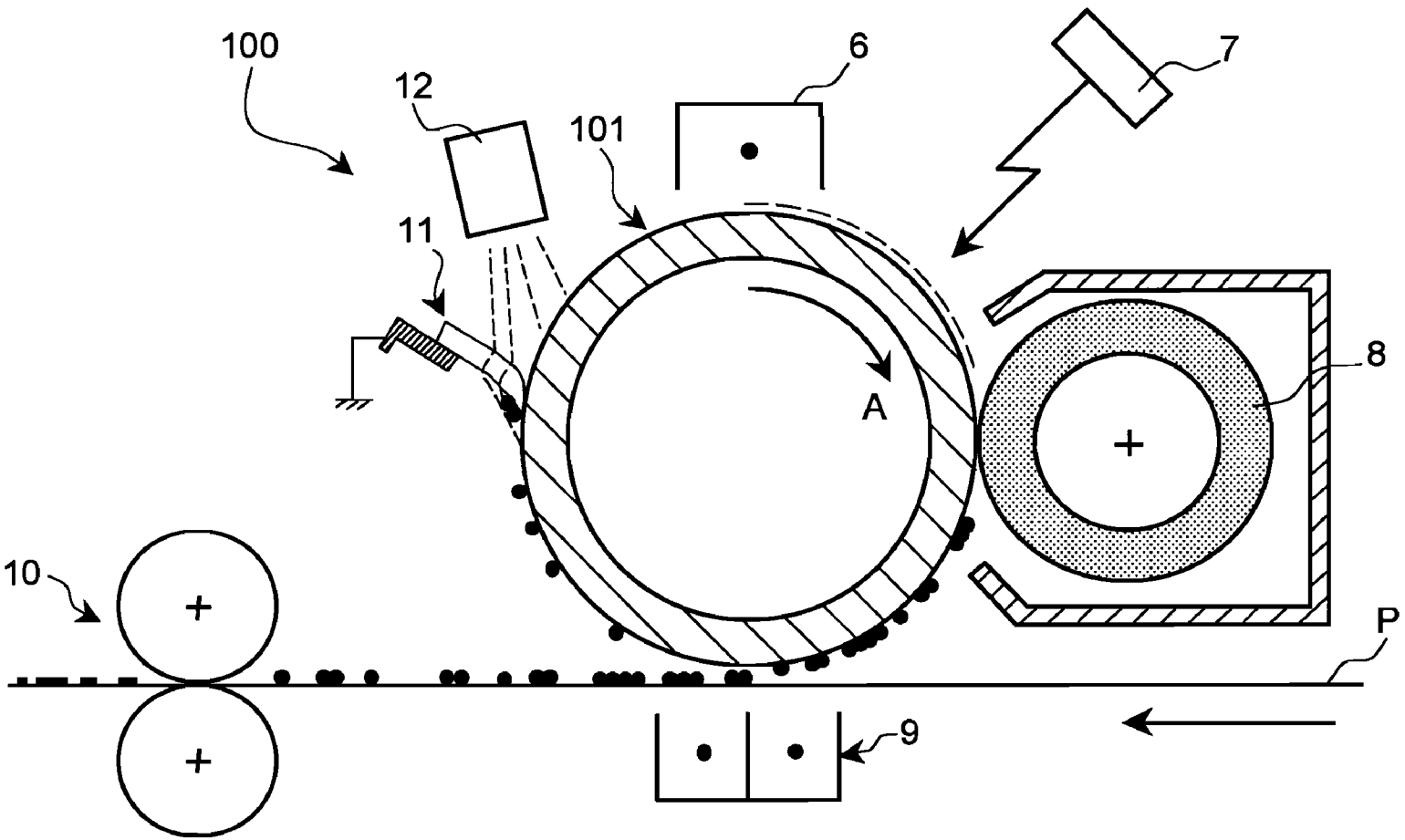
FIG. 1B is a schematic cross-sectional view of an image-forming device according to a second embodiment of the present invention.
Figure 1C:
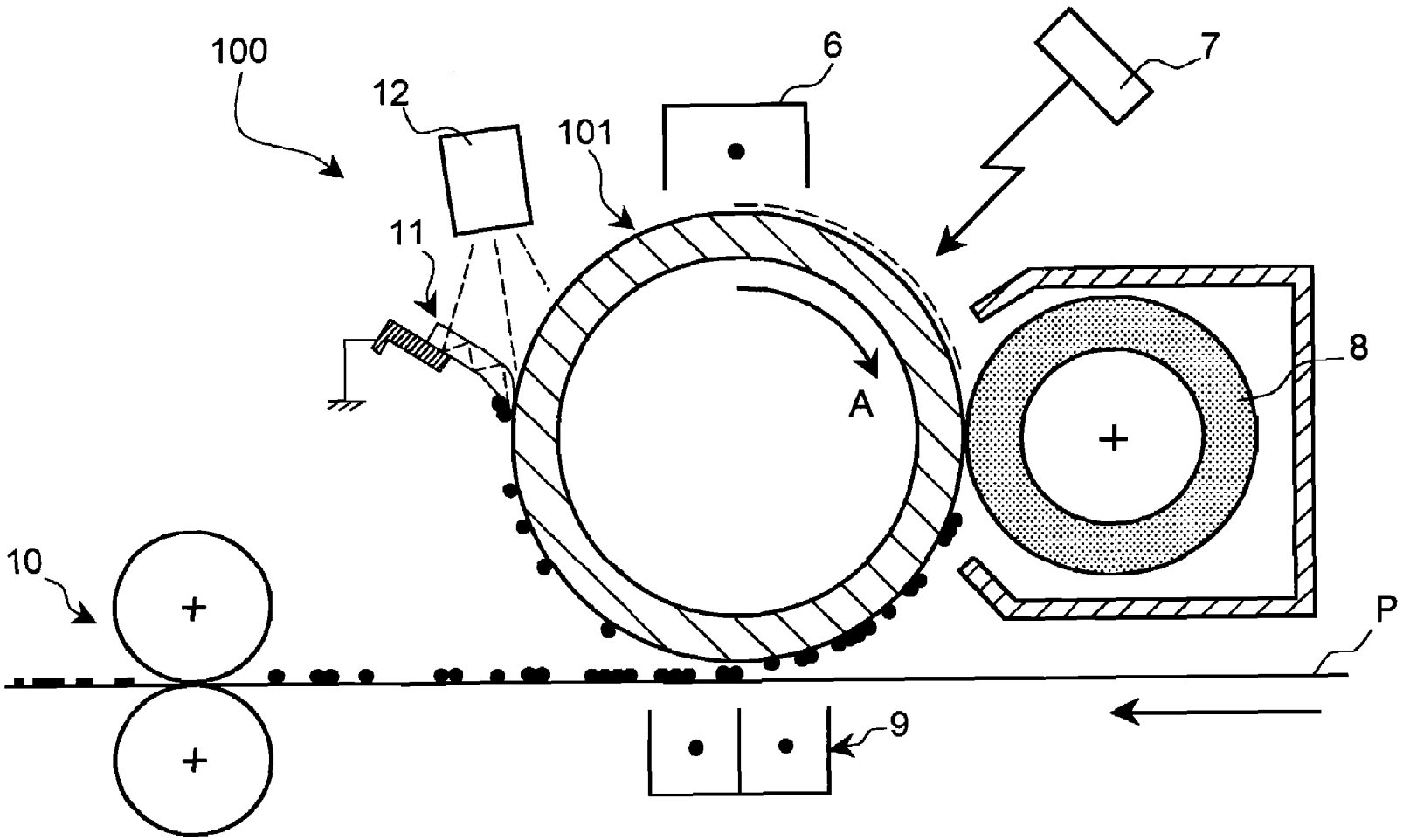
FIG. 1C is a schematic cross-sectional view of an image-forming device according to a third embodiment of the present invention.

An image-forming device according to a second embodiment of the present invention is described below with reference to FIGS. 1B, 3C, and 5. Components different from those of the image-forming device according to the first embodiment are mainly described below. The same components as those of the image-forming device according to the first embodiment will not further be described.

In the present embodiment, unlike the first embodiment, a photoirradiation member is used as a static eliminating unit. A cleaning blade 11 is used only as a pressing member. The photoirradiation member according to the present embodiment is a static eliminator 12.

The static eliminator 12 irradiates a "target irradiation region" with light to discharge the static electricity of a deposit, such as residual toner, to a substrate 1. The target irradiation region includes a contact region between the cleaning blade 11 and a photosensitive layer 2 and its upstream neighborhood at a distance of 0 to 3 cm from the contact region on the electrophotographic photoreceptor 101 in the rotation direction of the electrophotographic photoreceptor 101 (indicated by arrow A in FIG. 1B). The static eliminator 12 can reduce the discharge breakdown of a photoconductive sublayer 4.

Figure 3C:
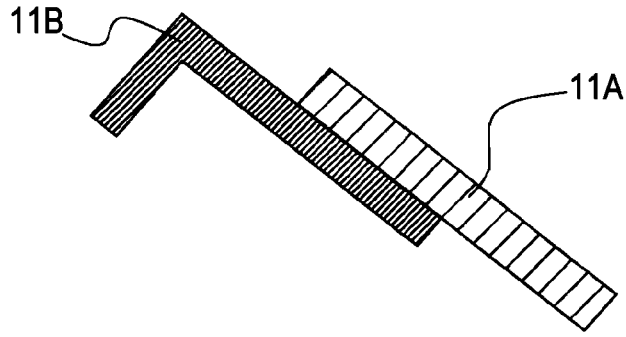
FIG. 3C is a cross-sectional view of a cleaning blade according to the second embodiment of the present invention.

As illustrated in FIG. 3C, the cleaning blade 11 according to the present embodiment includes a pressing substrate 11A and a support 11B. The pressing substrate 11A is formed of an optically transparent insulating resin material (such as polyurethane, polypropylene, or polyethylene terephthalate). The electrophotographic photoreceptor 101 is irradiated with light emitted from the static eliminator 12 and passing through part of the cleaning blade 11. The irradiation eliminates the static electricity of a deposit on the electrophotographic photoreceptor 101. The pressing substrate 11A is formed of an insulating material and is therefore nonconductive. Thus, the cleaning blade 11 according to the present embodiment does not function as a static eliminating unit and functions only as a pressing member.

The photoirradiation member may also be a halogen lamp or an electroluminescent source.

A possible mechanism of eliminating static electricity by photoirradiation is described below. When the target irradiation region including a residual deposit, such as residual toner, is irradiated with light from the static eliminator 12, the resistance of the target irradiation region in the photosensitive layer 2 decreases. Thus, the static electricity of the deposit, such as residual toner, is discharged through the photosensitive layer 2 of the target irradiation region to the substrate 1. Because the substrate 1 is grounded, the static electricity is discharged outside from the substrate 1.

The operation of the image-forming device 100 according to the present embodiment includes a first step of eliminating the static electricity of a deposit on the photosensitive layer 2 with the photoirradiation member and a second step of removing a neutralized deposit from the photosensitive layer 2 with the cleaning blade 11. These steps can reduce discharge breakdown during the operation of the image-forming device 100. The first step and the second step may be performed at the same time. Alternatively, the first step may be followed by the second step. In both cases, discharge breakdown during the removal of a deposit can be prevented or reduced.

As in the present embodiment, when the static eliminator 12 also serves as a photoirradiation member, the pressing substrate 11A of the cleaning blade 11 preferably has a light transmittance of at least 15%. This allows light from the photoirradiation member to pass through the cleaning blade 11 and reach the electrophotographic photoreceptor 101 more easily. When the static eliminator 12 also serves as a photoirradiation member, a standalone photoirradiation member can be omitted. The image-forming device 100 can therefore be downsized. Alternatively, both the static eliminator 12 and the photoirradiation member may be provided.

Figure 5:
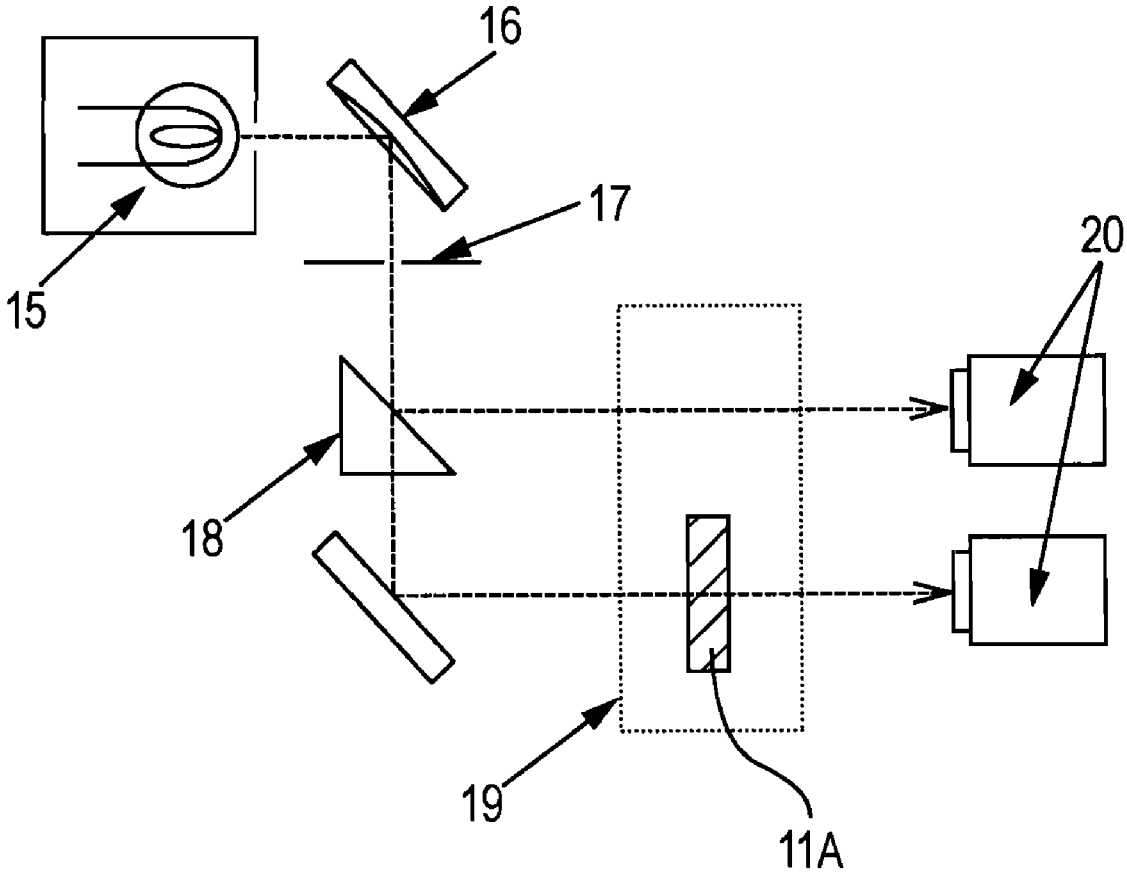
FIG. 5 is a schematic view of an apparatus for measuring the light transmittance.

The light transmittance of the pressing substrate 11A is measured with a double-beam spectrophotometer (for example, double-beam spectrophotometer (UV-2400PC), Shimadzu Corporation), as illustrated in FIG. 5. In a double-beam spectrophotometer, a single-wavelength light beam from a light source 15 enters a beam splitter 18 through a grating 16 and a slit 17. The beam splitter 18 divides the light beam into two. One light beam enters a first light quantity measuring apparatus 20 through a sample (pressing substrate 11A) placed in a measurement chamber 19. The other light beam directly enters a second light quantity measuring apparatus 20. The light transmittance of the sample is determined from difference in light quantity between the first light quantity measuring apparatus 20 and the second light quantity measuring apparatus 20.

Third Embodiment

An image-forming device according to a third embodiment of the present invention is described below with reference to FIGS. 1C, 3D, 5, and 6. Components different from those of the image-forming device according to the second embodiment are mainly described below. The same components as those of the image-forming device according to the second embodiment will not further be described.

Figure 3D:
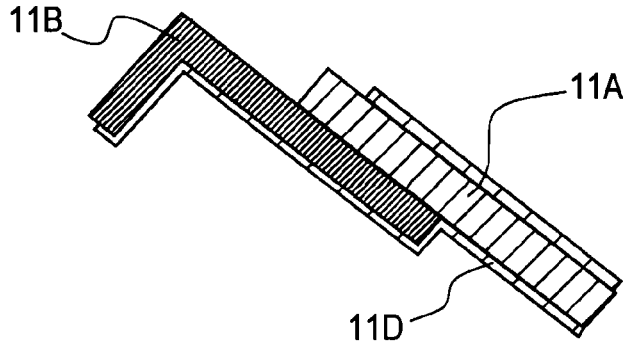
FIG. 3D is a cross-sectional view of a cleaning blade according to the third embodiment of the present invention.

As illustrated in FIG. 3D, a cleaning blade 11 according to the present embodiment includes a pressing substrate 11A, a support 11B bonded to the pressing substrate 11A, and electroconductive thin films 11D. The pressing substrate 11A is formed of an optically transparent resin material. The electroconductive thin films 11D are bonded to both sides of the pressing substrate 11A and one side of the support 11B. As in the second embodiment, a static eliminator 12 is used as a photoirradiation member. A photosensitive layer 2 of an electrophotographic photoreceptor 101 is irradiated with light passing through the pressing substrate 11A of the cleaning blade 11. As illustrated in FIG. 3D, light incident from the static eliminator 12 is reflected by the electroconductive thin films 11D and is efficiently directed to a target irradiation region through the pressing substrate 11A. This increases the efficiency of static elimination.

As in the second embodiment, when the static eliminator 12 also serves as a photoirradiation member, the pressing substrate 11A of the cleaning blade 11 preferably has a light transmittance of at least 15%. This allows light from the static eliminator 12 to pass through the cleaning blade 11 and reach the electrophotographic photoreceptor 101 more easily. When the static eliminator 12 also serves as a photoirradiation member, a standalone photoirradiation member can be omitted. The image-forming device 100 can therefore be downsized. Alternatively, both the static eliminator 12 and the photoirradiation member may be provided.

Figure 6:
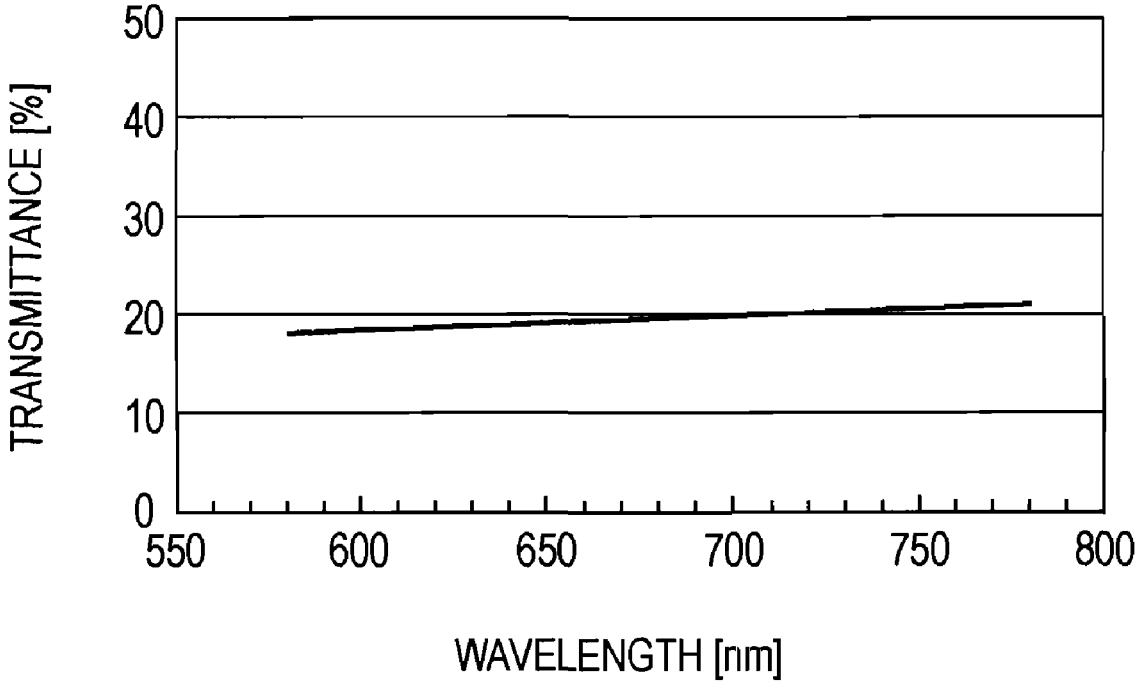
FIG. 6 is a graph illustrating the light transmittance of a pressing member according to the present invention.

The light transmittance of the pressing substrate 11A is measured with a double-beam spectrophotometer (for example, double-beam spectrophotometer (UV-2400PC), Shimadzu Corporation), as described above. FIG. 6 illustrates the light transmittance of the pressing substrate 11A of the cleaning blade 11 according to the third embodiment. The light transmittance was measured at a wavelength of 580 nm to 780 nm, a slit width of 0.5 nm, and a sampling pitch of 0.1 nm. As shown in FIG. 6, the light transmittance of the pressing substrate 11A of the cleaning blade 11 is about 20% and is apparently higher than 15%.

In the present embodiment, the cleaning blade 11 may be used as a static eliminating unit by bringing the electroconductive thin film 11D into contact with the photosensitive layer 2.

While various toners, such as polymerized toners or grinded toners, may be used in the first embodiment to the third embodiment, grinded toners tend to generate a greater amount of static electricity than polymerized toners. Hence, the present invention is more effectively applied to when grinded toners are used.

The present invention may be practiced in other various embodiments without departing from the spirit and the major features of the present invention. The present embodiments are provided for illustration only in all respects. The present invention is limited only by the claims that follow and is not limited by the description. Variations and modifications of the following claims are within the scope of the present invention.

What is claimed is:

1. A static removing device for an image-forming apparatus comprising:

an electrophotographic photoreceptor including a photosensitive layer;

a pressing member pressed against the photosensitive layer of the electrophotographic photoreceptor to remove a deposit from the photosensitive layer; and a static eliminating unit for eliminating the static electricity of the deposit to be removed by the pressing member, wherein the static eliminating unit includes a photoirradiation member for irradiating the photosensitive layer with light to eliminate the static electricity of the deposit, and wherein the pressing member is optically transparent, and the photoirradiation member is disposed so that the photosensitive layer is irradiated with light passing through the pressing member.

2. The static removing device for the image-forming apparatus according to claim 1, wherein the pressing member has a light transmittance of at least 15%.

* * * * *